United States Patent [19]

Johnson

[11] 3,981,029

[45] Sept. 21, 1976

[54] DUAL LEVEL TOILET FLUSHER

[75] Inventor: Allen M. L. Johnson, Succasunna, N.J.

[73] Assignee: The Raymond Lee Organization, Inc., New York, N.Y. ; a part interest

[22] Filed: Sept. 24, 1975

[21] Appl. No.: 616,279

[52] U.S. Cl. ..... 4/67 A; 4/34; 4/37; 4/58; 4/63

[51] Int. Cl.[2] ..... E03D 1/34; E03D 5/02; A61B 19/00

[58] Field of Search ..... 4/67 A, 67 R, 57 R, 4/34, 37, 58, 63, 1

[56] References Cited

UNITED STATES PATENTS

| | | | |
|---|---|---|---|
| 2,532,977 | 12/1950 | White | 4/67 A |
| 2,674,744 | 4/1954 | White | 4/67 A |
| 3,894,299 | 7/1975 | Cleary | 4/67 A |
| 3,906,554 | 9/1975 | Johnson | 4/67 A |
| 3,934,276 | 1/1976 | Karlson | 4/41 |

*Primary Examiner*—Henry K. Artis
*Attorney, Agent, or Firm*—Howard I. Podell

[57] ABSTRACT

The dual level toilet flusher is a toilet tank flush mechanism which permits the user to either flush the full tank of water or to flush a lesser preset volume of water, depending on the direction of rotation of the flush handle. The flush mechanism incorporates a float valve fitted with a slidable ballast which changes the flotation characteristic of the float valve, to cause the valve to assume a negative buoyancy and close at one of two levels of water in the tank, depending on the position of the slidable ballast. The flush handle is fitted to a shaft of non-circular cross section which rides in shaped openings in each of two lever arms inside the tank, so that rotation of handle and shaft in one direction causes rotation of only one of the lever arms and rotation of the shaft in the opposite direction causes rotation of only the second lever arm, with the position of the slidable ballast oriented with respect to the float valve by the lever arm which is rotated, with rotation of either lever arm raising the float valve.

2 Claims, 7 Drawing Figures

DUAL LEVEL TOILET FLUSHER

SUMMARY OF THE INVENTION

My invention is a toilet tank flush mechanism which permits the user to either flush the full tank of water or to flush a lesser pre-set volume of water, depending on the direction of rotation of the flush handle.

The flush mechanism incorporates a float valve fitted with a slidable ballast which changes the flotation characteristic of the float valve, to cause the valve to assume a negative buoyancy and close at one of two levels of water in the tank, depending on the position of the slidable ballast.

The flush handle is fitted to a shaft of non-circular cross section which rides in shaped openings in each of two lever arms inside the tank, so that rotation of handle and shaft in one direction causes rotation of only one of the lever arms and rotation of the shaft in the opposite direction causes rotation of only the second lever arm, with the position of the slidable ballast oriented with respect to the float valve by the lever arm which is rotated, with rotation of either lever arm raising the float valve.

One lever arm is fastened to the float assembly by a rigid member, and the other lever arm is fastened to the float assembly by a flexible chain.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
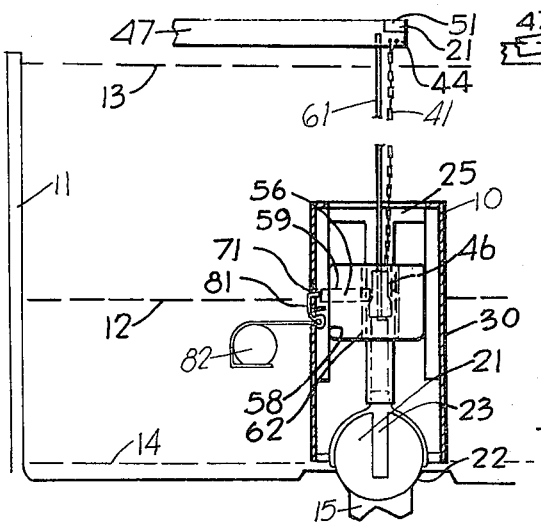
FIG. 1 is a sectional view of a toilet tank fitted with the invention.

Turning now descriptively to the drawings, in which similar reference characters denote similar elements throughout the several views, FIGS. 1–6 show the mechanism of the float valve assembly 10 mounted in a conventional toilet tank 11 so as to flush water in tank 11 through drain 15 from an initial level 13 to either an intermediate level 12 or to a level 14 near bottom of the tank 11.

As shown in FIG. 1, a float ball 21 rests on top of the opening 22 of drain 15 of tank 11 to prevent water in tank 11 from entering drain 15 except during a flushing operation. Ball 21 is permanently gripped by fingers 23 attached to the bottom of hollow sleeve rod 25 which is slidably mounted inside of circular frame 30. Circular frame 30 is fixed to the overflow stand pipe in tank 11. A flexible chain 41 is fastened to the top of sleeve rod 25 and connected to the free end of a first operating lever 51 that is rotated so as to pull chain 41, sleeve rod 25 and ball 21 upwards to free ball 21 from the opening

Figure 6:
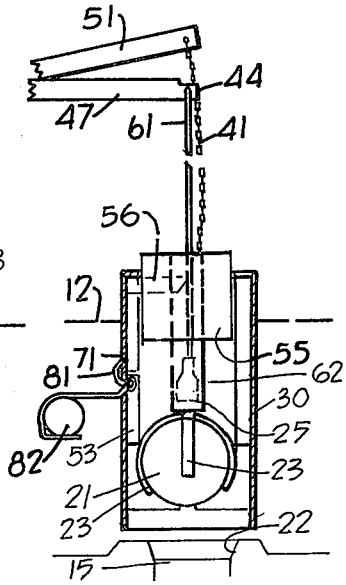
FIG. 6 is a sectional view of the valve assembly when operated for a partial flush of the tank.

22 of drain 15, partially flushing the tank 11, as shown in FIG. 6.

As shown in FIGS. 1, 2, 6 and 7, a cylindrical ballast 55 with an axial hole 46 is slidably mounted about sleeve rod 25 inside of frame 30. A slidable cam 56 is mounted through a radial opening 95 in ballast 55 so that in the normal position, the outer end 59 of cam 56 lies between a pair of rods 91 in frame 30. The inner end face 69 of cam 56, which is beveled, extends through a hole 92 atop of slot 93 of sleeve rod 25 and lies within the hollow interior 27 of sleeve rod 25.

A rigid rod 61, attached to the free end 44 of second operating lever 47 is fitted to a beveled shaped knob 62. Knob 62 rides in the interior 27 of sleeve rod 25 and bears, when lifted by rod 61, against a top inner flange 63 so as to lift rod 25. In the normal position, shown in FIG. 1, knob 62 hangs retained at the bottom of rod 61.

Figure 2:
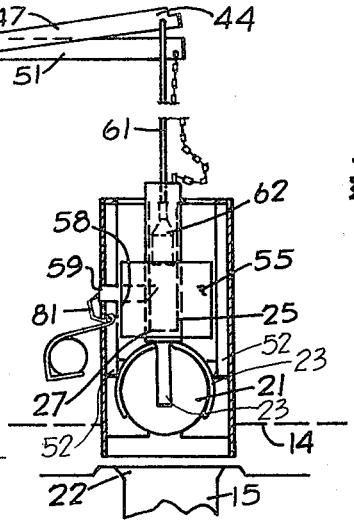
FIG. 2 is a sectional view of the valve assembly, when operated for a full flush of the tank.

As shown in FIG. 2, when rod 61 lifts knob 62, knob 62 bears against the beveled end face 69 of cam 56 to move cam 56 laterally into slot 71 of frame 30 and anchor cam 56 and ballast 55 from further movement with respect to frame 30. Knob 62 continues to rise until it bears against flange 63 and lifts sleeve rod 25 and attached float ball valve 21 free of drain opening for purposes of fully flushing the contents of tank 11.

With float valve 21 lifted off of drain opening 22 and ballast 55 locked in position to frame 30, as shown in FIG. 2, float valve 21 will not reseat on drain opening 22 until the water level falls below the center of buoyancy of ball valve 21, or level line 14, since the weight of ballast 55 does not affect the buoyancy of ball valve 21, thus providing for a full flush of tank 11.

However, as shown in FIG. 6, when sleeve rod 25 is lifted by chain 41 attached to sleeve rod 25, cam 56 is not engaged by slot 71 in frame 30, but by hole 92 in sleeve rod 25. Ballast 55 is of a size and weight such that the combination of ball valve 21 and ballast 55 will have positive flotation characteristics when ballast 55 is completely submerged, but the combination has negative flotation characteristics when ballast 55 rests above the water level. Hence, as shown in FIG. 6, the weight of ballast 55 acts to force ball valve 21 to close drain opening 22, once the water level falls to level 12, below the top of ballast 55, for a partial flush.

Cam 56 is returned to the normal position after a full flush operation by the action of lever 81 pivotably mounted to frame 30 and fastened about a float ball 82. Float ball 82 has sufficient buoyancy to push lever 81 against, and slide cam 56 out of the engaged position in slot 71 when the inner face 69 of cam 56 does not bear against knob 62.

The selective rotation of levers 47 and 51 is accomplished by the operation of handle shaft 101 which is of square cross-section and is externally fixed on the tank wall to handle 102. Markings 103 on the handle 102 inform the user to lift the handle 102 for a partial flush operation or to push the handle down to accomplish a full flush operation.

Figure 3:
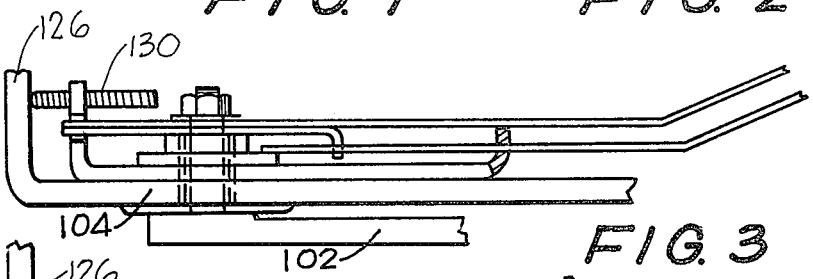
FIG. 3 is a top view of the operating lever arms.
Figure 4:
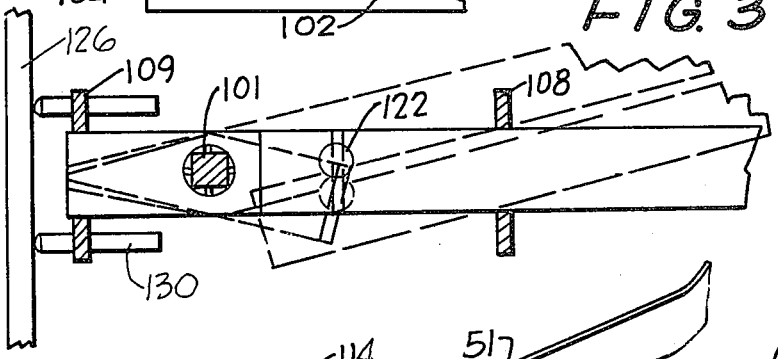
FIG. 4 is a side view of the lever arms.
Figure 5:
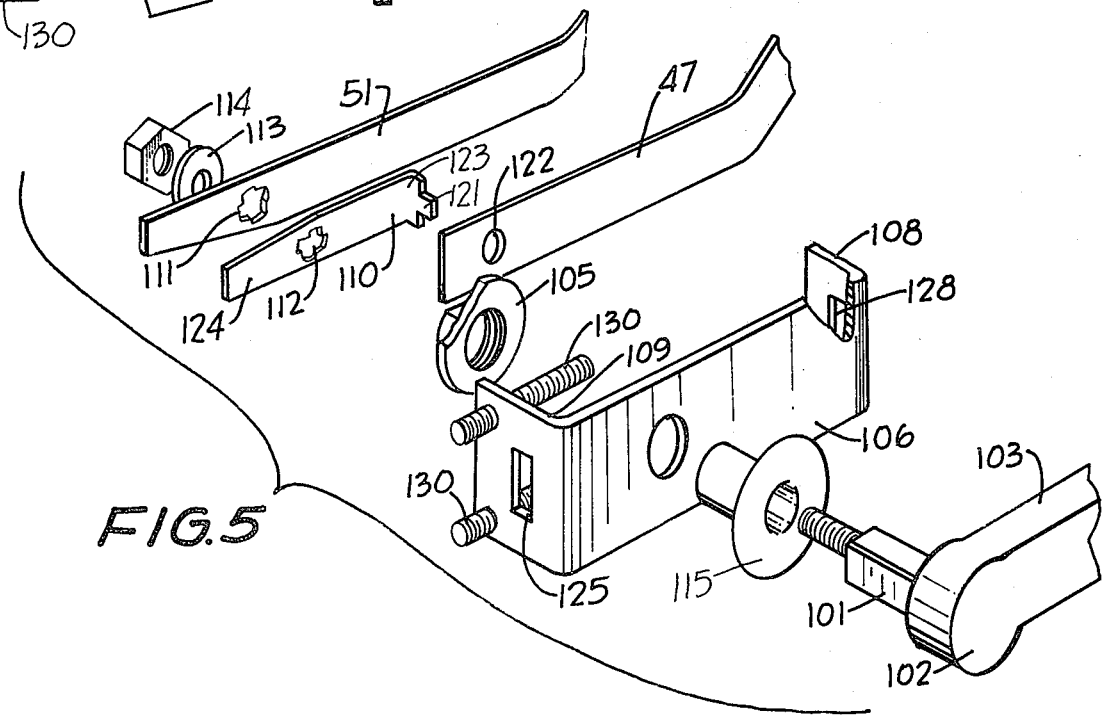
FIG. 5 is an exploded perspective view of the lever arm assembly.
Figure 7:
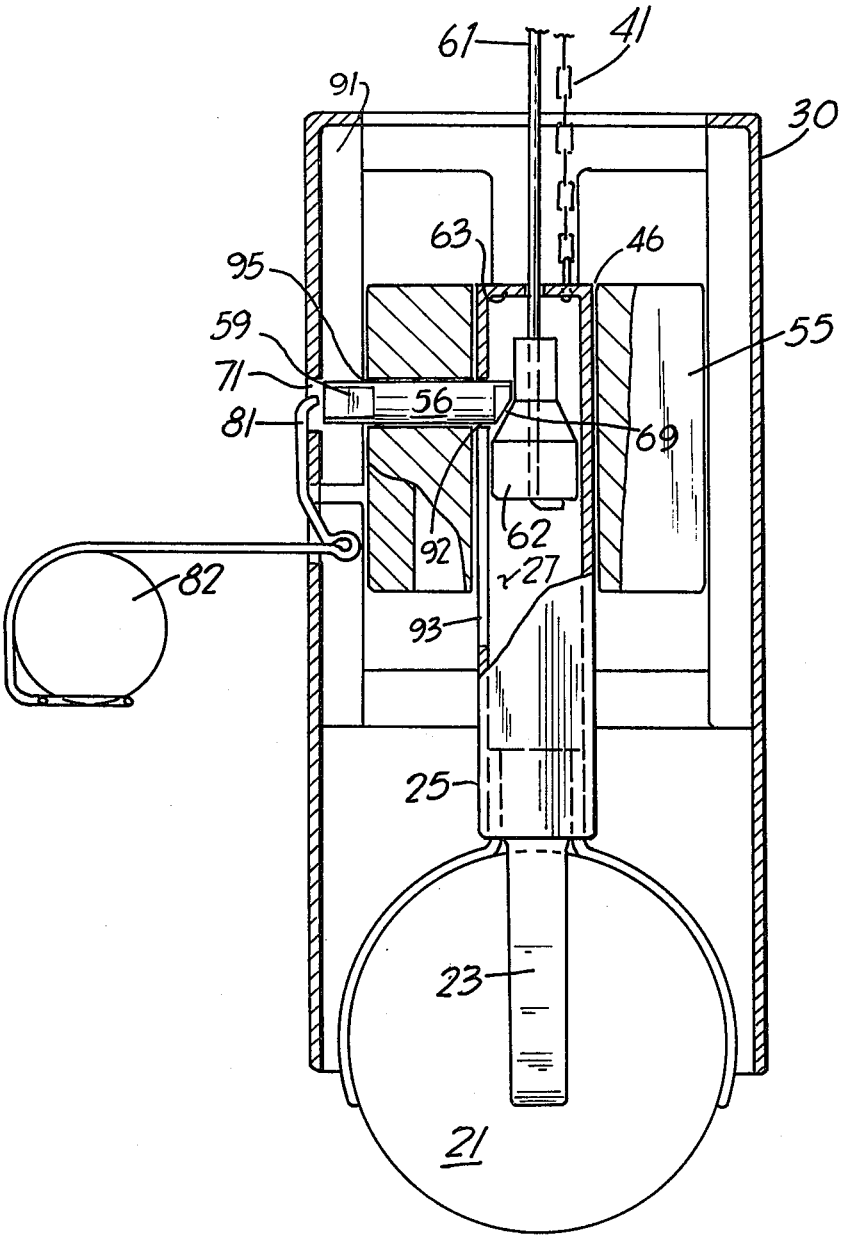
FIG. 7 is a sectional view of the valve assembly.

As shown in FIGS. 3–5, the handle shaft 101 is rotatably mounted in a sleeve 115, joined by a nut 105 to the tank wall 104 and a U-shaped bracket 106 mounted by the sleeve against the inside surface of the tank wall 104, with both legs 108 and 109 of bracket extending away from wall 104.

Lever 51 and 110, are each formed with a distinctive shaped hole 111 and 112 respectively to enable levers 51 and 110 to loosely slip over the square sectional portion of shaft 101, being loosely kept in place by a nut 114 and washer 113 fastened to the threaded end 115 of shaft 101. Hole 111 of lever 51 is shaped to permit shaft 101 to freely rotate when handle 102 is pressed down to initiate a full flush operation, without rotating lever 51, while causing engaging and rotating of lever 51 with shaft 101 when the handle is lifted upwards for initiating a partial flush operation. Hole 112 is located as a mirror image of hole 111, in lever 110 so as to engage only lever 110 with shaft 101 when shaft 101 is rotated in the direction of pressing down on handle 102.

Lever 110 is bent at a first end 123 with a flange 121 that fits in a hole 122 near the end of lever 47, with the second end 124 of lever 110 fitting loosely in slot 125 of bracket leg 109 located towards the adjacent end wall 126 of the tank 11. Lever 47 passes freely through slot 128 of the bracket leg 108 so that lever 47 rotates in the opposite direction of engaged lever 110, when lever 110 is rotated by shaft 101. Screws 130 are mounted in flange 109 to bear against tank end wall 126 to prevent bracket 106 from rotating.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. Apparatus for selectively flushing the tank of a toilet so as to cause one of two different quantities of volume of water to flush when the apparatus is operated, comprising a float which is mountable over the drain outlet of a toilet tank so as to seal the tank when the float lies against the drain opening, said float fitted at its top to a hollow sleeve, the other end of which sleeve is joined by a tension member to a first operating lever, a ballast member formed with an axial opening of a size to freely slide over said sleeve, said ballast member slidably mounted in a frame that may be fixed to the structure of the toilet tank, a rod, one end of which is fixed to a knob slidably located in the interior of the sleeve, the other end of the rod being fastened by a tension member to a second operating lever, means to selectively individually rotate either one of the operating levers so as to apply tension force and lift either the hollow sleeve or the slidable knob, depending on the lever which is so rotated, means to latch the ballast to the frame, said means linked to the motion of the said slidable knob such that the weight of the ballast is removed from the float valve when the ballast is latched to the frame causing the float to remain unseated after being lifted off the drain opening until the water level of the tank has dropped below to a first level which affords negative buoyancy to said float valve, said ballast, when not latched to the frame serving to cause the float to seat against the drain opening when the water level of the tank reaches a second level higher than said first level.

2. The combination as recited in claim 1 together with a handle and attached shaft adaptable for mounting to the wall of a toilet tank, said shaft linked by means to each of the operating levers so as to cause one, and only one of the operating levers to rotate in a given direction and thus to apply a lifting force to its attached tension member when the shaft is rotated in a first direction, said means causing the other, and only the other operating lever to rotate in the same said given direction when the shaft is rotated in the second direction.

* * * * *